US010062527B2

(12) United States Patent
Williams

(10) Patent No.: US 10,062,527 B2
(45) Date of Patent: Aug. 28, 2018

(54) TRANSFER SWITCHES WITH DUAL MECHANISM CONTROL AND RELATED ASSEMBLIES AND METHODS

(71) Applicant: Eaton Corporation, Cleveland, OH (US)

(72) Inventor: Scott Morgan Williams, Etowah, NC (US)

(73) Assignee: Eaton Intelligent Power Limited, Dublin (IE)

( * ) Notice: Subject to any disclaimer, the term of this patent is extended or adjusted under 35 U.S.C. 154(b) by 57 days.

(21) Appl. No.: 15/195,354

(22) Filed: Jun. 28, 2016

(65) Prior Publication Data

US 2017/0372852 A1 Dec. 28, 2017

(51) Int. Cl.
*H01H 9/26* (2006.01)
*H01H 9/16* (2006.01)

(52) U.S. Cl.
CPC ..... *H01H 9/26* (2013.01); *H01H 9/16* (2013.01); *H01H 2300/018* (2013.01)

(58) Field of Classification Search
CPC .... H01H 33/52; H01H 2300/018; H01H 3/00; H01H 3/02; H01H 3/08; H01H 3/32; H01H 3/42; H01H 2003/00; H01H 2003/02; H01H 2009/20; H01H 2009/26; H01H 2009/267
USPC ..... 335/8, 159–161, 7, 10; 200/50.32, 50.4, 200/50.33, 50.35, 50.37
See application file for complete search history.

(56) References Cited

U.S. PATENT DOCUMENTS 3,258,572 A * 6/1966 Archer ..... H01H 71/0207 200/237
2006/0131146 A1* 6/2006 Filippenko ..... H01H 9/26 200/50.33

* cited by examiner

*Primary Examiner* — Anthony R. Jimenez
(74) *Attorney, Agent, or Firm* — Myers Bigel, P.A.

(57) ABSTRACT

A contactor assembly for a transfer switch includes a housing, first and second operating mechanisms in the housing, a first contact assembly in the housing and adjacent the first operating mechanism, a second contact assembly in the housing and adjacent the second operating mechanism, and a central control system in the housing and coupled to each of the first and second operating mechanisms. The central control system is configured to be manually actuated (i) in a first way to cause the first operating mechanism to change the first contact assembly to a closed state and to lock the second contact assembly in an open state and (ii) in a second way to cause the second operating mechanism to change the second contact assembly to a closed state and to lock the first contact assembly in an open state.

18 Claims, 9 Drawing Sheets

TRANSFER SWITCHES WITH DUAL MECHANISM CONTROL AND RELATED ASSEMBLIES AND METHODS

BACKGROUND

Today more and more residential and commercial sites are employing some type of secondary or backup power source to protect against power outages. When a secondary power source is installed, a transfer switch is also typically installed to provide a switchable connection between the primary power source and a load or the secondary power source and the load.

SUMMARY

Some embodiments of the present invention are directed to a contactor assembly for a transfer switch. The contactor assembly includes a housing, first and second electromechanical operating mechanisms in the housing, a first contact assembly in the housing and adjacent the first operating mechanism, a second contact assembly in the housing and adjacent the second operating mechanism, and a mechanical central control system in the housing and coupled to each of the first and second operating mechanisms. The first operating mechanism is configured to change the first contact assembly from an open state to a closed state. The second operating mechanism is configured to change the second contact assembly from an open state to a closed state. The central control system is configured to be manually actuated (i) in a first way to cause the first operating mechanism to change the first contact assembly to the closed state and to lock the second contact assembly in the open state and (ii) in a second way to cause the second operating mechanism to change the second contact assembly to the closed state and to lock the first contact assembly in the open state.

After the central control system has been actuated in one of the first and second ways, the central control system may be configured to be manually actuated in a third way so that each of the first and second contact assemblies are unlocked and in the open state.

According to some embodiments, each of the first and second contact assemblies comprises one or more spring-loaded contacts that are configured to change the first or second contact assembly that was in the closed state to the open state in response to actuation of the central control system in the third way.

The central control system may include a lever having first and second opposite ends. The central control system may be configured to be manually actuated in the first way by pressing the first end of the lever, and the central control system may be configured to be manually actuated in the second way by pressing the second end of the lever.

The central control system may include a button. The central control system may be configured to be manually actuated in the third way by pressing the button.

According to some embodiments, the first and second operating mechanisms are spaced apart from one another with the central control system positioned between the first and second operating mechanisms.

The central control system may include a first pole shaft arm coupled to a first pole shaft of the first operating mechanism. The first pole shaft may rotate in response to the central control system being actuated in the first way and the first pole shaft arm may move in response to the rotation of the first pole shaft. The central control system may include a second trip wire coupled to the second operating mechanism adjacent a second trip shaft of the second operating mechanism. The second trip wire may be operatively coupled to first pole shaft arm. The second trip wire may rotate the second trip shaft in a first direction in response to the movement of the first pole shaft arm to lock the second operating mechanism to thereby lock the second contact assembly in the open state. The second trip shaft may rotate in a second direction that is opposite the first direction in response to actuation of the central control system in the third way.

The central control system may include a second pole shaft arm coupled to a second pole shaft of the second operating mechanism. The second pole shaft may rotate in response to the central control system being actuated in the second way and the second pole shaft arm may move in response to the rotation of the second pole shaft. The central control system may include a first trip wire coupled to the first operating mechanism adjacent a first trip shaft of the first operating mechanism. The first trip wire may be operatively coupled to the second pole shaft arm. The first trip wire may rotate the first trip shaft in a first direction in response to the movement of the second pole shaft arm to lock the first operating mechanism to thereby lock the first contact assembly in the open state. The first trip shaft may rotate in a second direction that is opposite the first direction in response to actuation of the central control system in the third way.

According to some embodiments, the central control system includes first, second and third buttons. The central control system may be configured to be manually actuated in the first way by pressing the first button. The central control system may be configured to be manually actuated in the second way by pressing the second button. The central control system may be configured to be manually actuated in the third way by pressing the third button.

Some other embodiments of the present invention are directed to a method. The method includes providing a transfer switch including a contactor assembly. The contactor assembly includes first and second electromechanical operating mechanisms, a first contact assembly in an open state, a second contact assembly in an open state, and a mechanical central control system coupled to each of the first and second operating mechanisms. The first operating mechanism is configured to change the first contact assembly from the open state to a closed state. The second operating mechanism configured to change the second contact assembly from the open state to a closed state. The method includes selectively closing one of a primary power source and a secondary power source by actuating the central control system to place one of the first and second contact assemblies in the closed state. The method includes locking the other one of the first and second contact assemblies in the open state in response to selectively closing one of the primary power source and the secondary power source.

Locking the other one of the first and second contact assemblies in the open state may include locking the operating mechanism associated with the other one of the first and second contact assemblies.

Selectively closing one of the primary power source and the secondary power source may include actuating the central control system in a first way to place the first contact assembly in the closed state to thereby close the primary power source or actuating the central control system in a second way to place the second contact assembly in the closed state to thereby close the secondary power source.

According to some embodiments, the method includes, after the locking step, placing each of the first and second contact assemblies in an unlocked open state in response to actuating the central control system in a third way. Locking the other one of the first and second contact assemblies in the open state may include locking the operating mechanism associated with the other one of the first and second contact assemblies. Placing each of the first and second contact assemblies in an unlocked open state may include unlocking the operating mechanism associated with the other one of the first and second contact assemblies. Locking the operating mechanism associated with the other one of the first and second contact assemblies may include rotating a trip shaft of the operating mechanism in a first direction using the central control system. Unlocking the operating mechanism associated with the other one of the first and second contact assemblies may include rotating the trip shaft of the operating mechanism in a second, opposite direction using the central control system.

Some other embodiments of the present invention are directed to a contactor assembly for a transfer switch. The contactor assembly includes a housing, first and second electromechanical operating mechanisms in the housing, a first contact assembly in the housing and adjacent the first operating mechanism, a second contact assembly in the housing and adjacent the second operating mechanism, and a mechanical central control system in the housing and interlocking the first and second operating mechanisms. The first operating mechanism is configured to change the first contact assembly from an open state to a closed state, and the first contact assembly is electrically connected to a primary power source and configured to close the primary power source in the closed state. The second operating mechanism is configured to change the second contact assembly from an open state to a closed state, and the second contact assembly is electrically connected to a secondary power source and configured to close the secondary power source in the closed state. The central control system includes a primary power source actuator and a secondary power source actuator. The central control system is configured to (i) direct the first operating mechanism to change the first contact assembly to the closed state and to lock the second contact assembly in the open state in response to actuation of the primary power source actuator and (ii) direct the second operating mechanism to change the second contact assembly to the closed state and to lock the first contact assembly in the open state in response to actuation of the secondary power source actuator.

The central control system may include an open actuator. According to some embodiments, after actuation of the primary power source actuator or the secondary power source actuator, the central control system is configured place each of the first and second contact assemblies in an unlocked open state in response to actuation of the open actuator.

Figure 1:
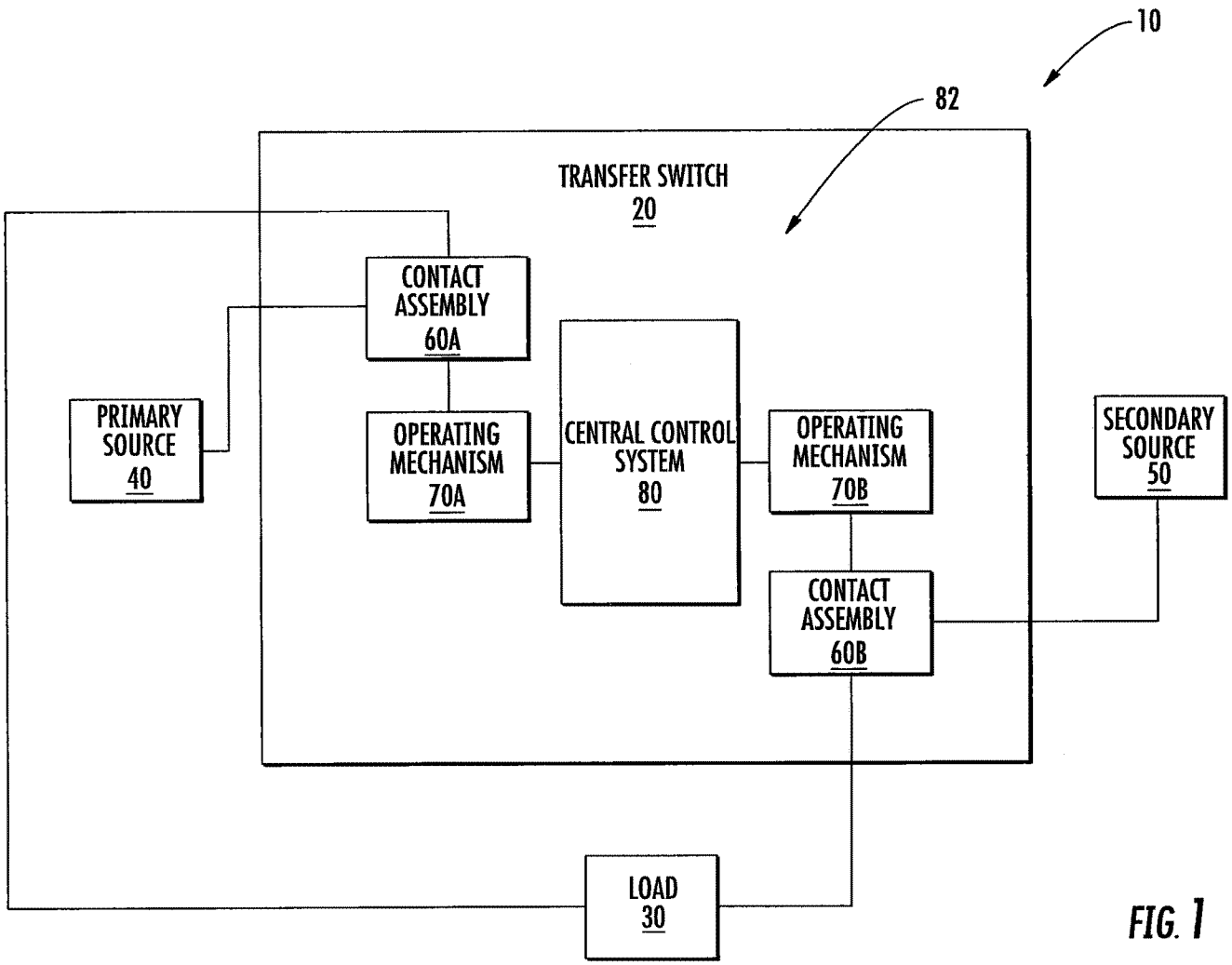
FIG. 1 is a schematic illustration of a transfer switch according to some embodiments of the invention.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

An electric power control system 10 is illustrated in FIG. 1. The system 10 includes a transfer switch 20 (e.g., an automatic transfer switch). The transfer switch 20 controls power flowing from a load 30 from either a primary power source 40 or a secondary power source 50. The primary power source 40 may be, for example, a utility power source (e.g., a connection to an electrical grid maintained by a utility power company). The secondary power source 50 may be, for example, an electric generator.

The transfer switch 20 includes a first contact assembly 60A and a second contact assembly 60B. The first contact assembly 60A selectively electrically connects and disconnects the load 30 to the primary power source 40. The second contactor 60B selectively electrically connects and disconnects the load 30 to the secondary power source 50.

The transfer switch 20 also includes a first operating mechanism 70A and a second operating mechanism 70B. As will be described in more detail below, the first operating mechanism 70A is operative to open and close contacts of the first contact assembly 60A and the second operating mechanism 70B is operative to open and close contacts of the second contact assembly 60B.

The transfer switch 20 further includes a central control system 80. The central control system 80 provides manual operation of the transfer switch 20. As will be described in more detail below, the central control system 80 is mechanically coupled to the first and second operating mechanisms 70A, 70B and interlocks the independent first and second operating mechanisms 70A, 70B.

Figure 2:
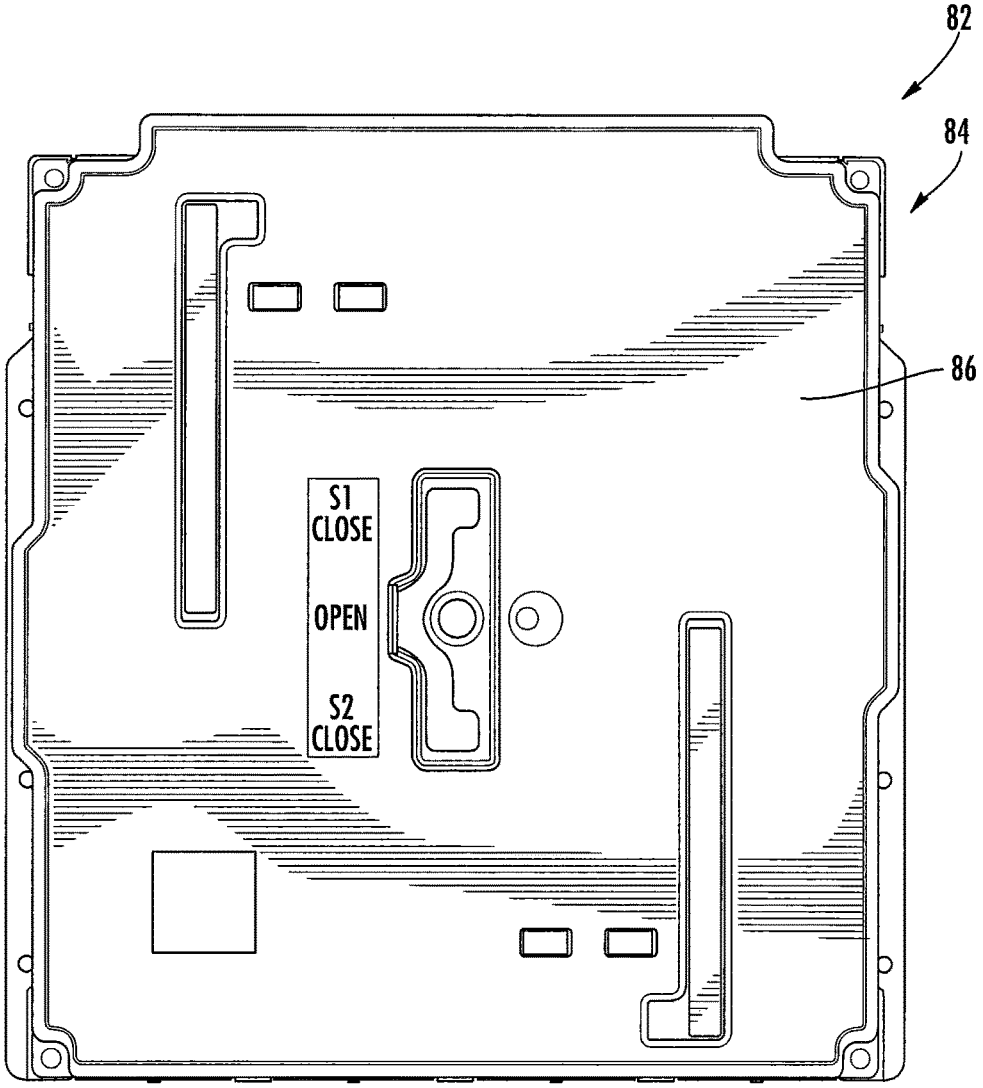
FIG. 2 is a front view of a contactor assembly of the transfer switch of FIG. 1 according to some embodiments.

The first contact assembly 60A, the second contact assembly 60B, the first operating mechanism 70A, the second operating mechanism 70B and/or the central control system 80 may be included as part of a contactor assembly or system 82. Referring to FIG. 2, the contactor assembly 82 may further include a housing 84 in which the first contact assembly 60A, the second contact assembly 60B, the first operating mechanism 70A, the second operating mechanism 70B and the central control system 80 are held. The contactor assembly 82 may also include a cover or door 86 that is pivotably and/or releasably connected to the housing 84 to cover at least some of the aforementioned components.

Figure 3:
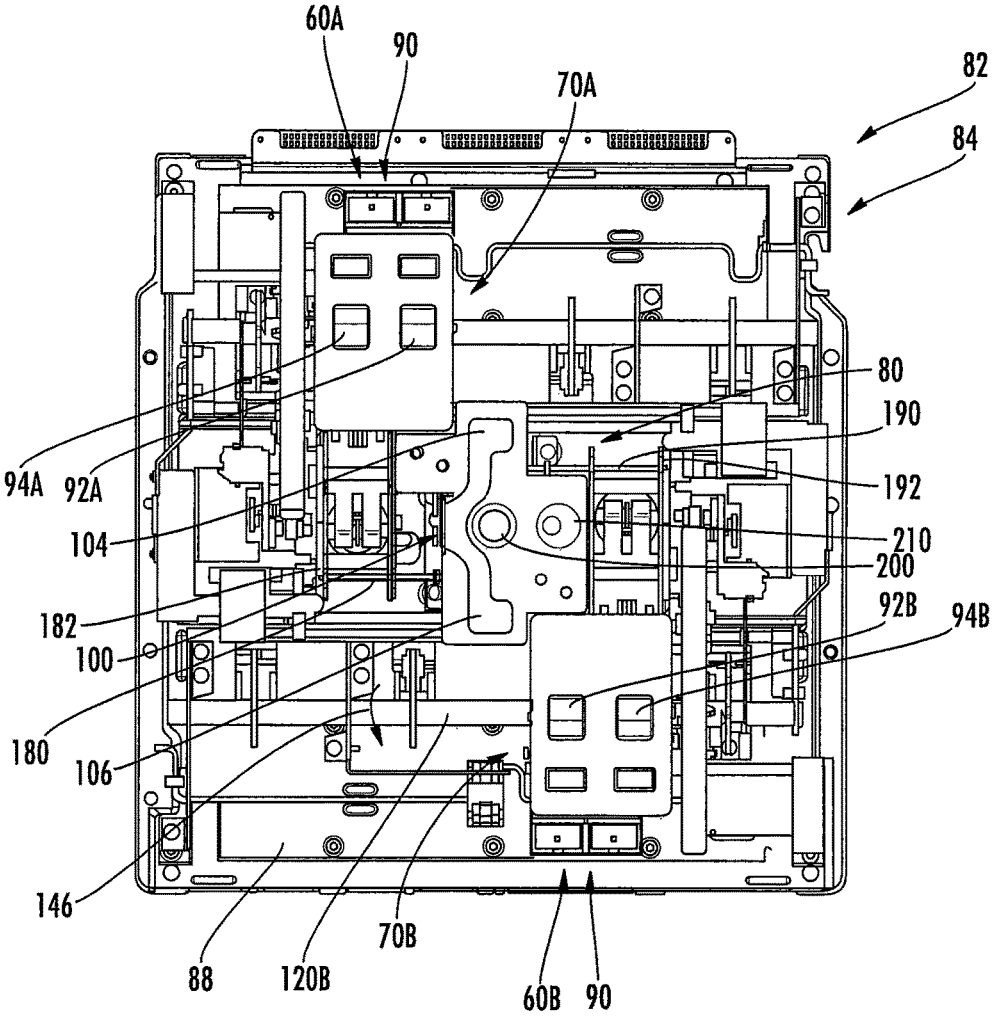
FIG. 3 is a front view of the contactor assembly of FIG. 2 with a door of the contactor assembly removed according to some embodiments.

FIG. 3 illustrates the contactor assembly 82 with the cover or door removed. The first contact assembly 60A, the second contact assembly 60B, the first operating mechanism 70A, the second operating mechanism 70B and/or the central control system 80 may be coupled to a back or rear wall 88 of the housing 84.

Each of the first and second contact assemblies 60A, 60B includes one or more contacts 90. The first operating mechanism 70A may include a first actuator 92A such as a first button that is used to manually close the contacts 90 of the first contact assembly 60A and a second actuator 94A such as a second button that is used to manually open the contacts 90 of the first contact assembly 60A. Similarly, the second operating mechanism 70B may include a first actuator 92B such as a first button that is used to manually close the contacts 90 of the second contact assembly 60B and a second actuator 94B such as a second button that is used to manually open the contacts 90 of the second contact assembly 60B.

Figure 4:
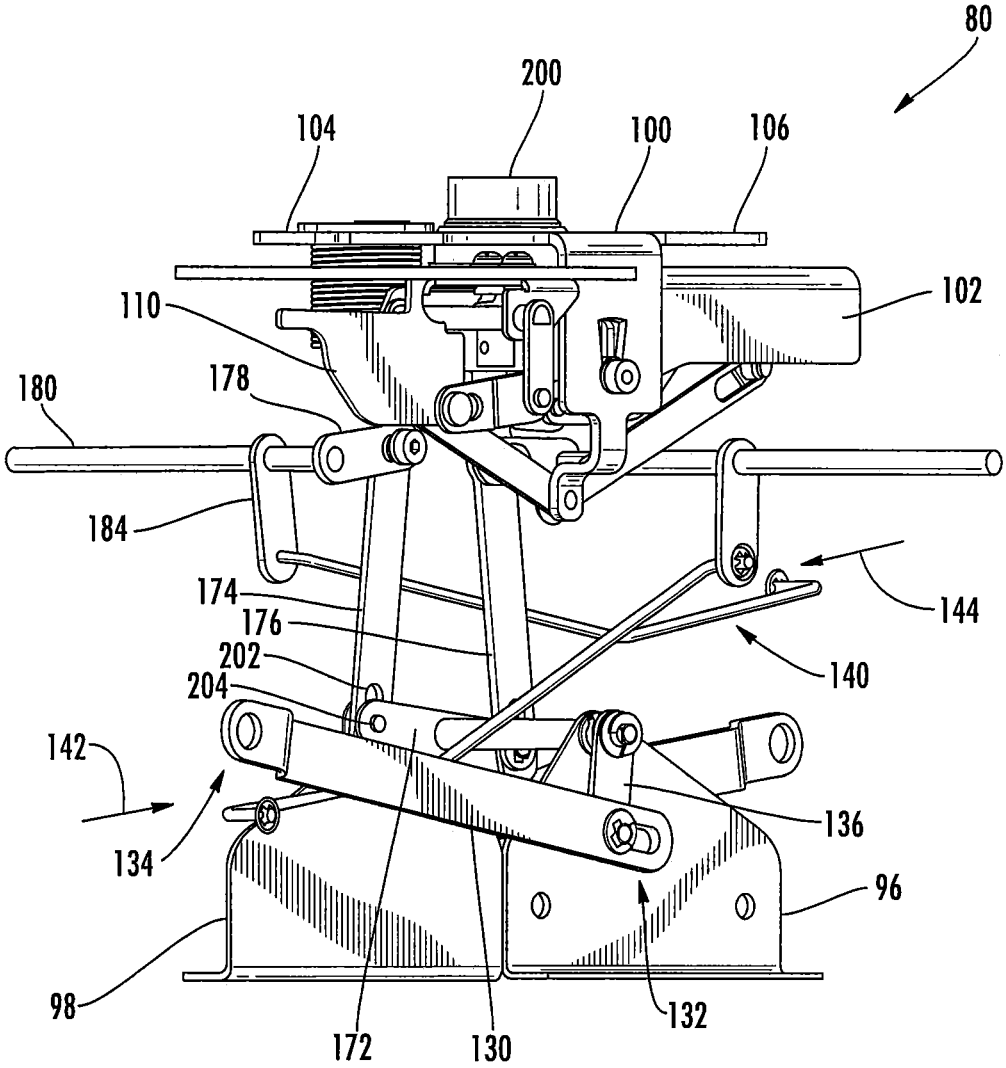
FIGS. 4 and 5 are perspective views of a central control system of the contactor assembly of FIG. 3 according to some embodiments.
Figure 5:
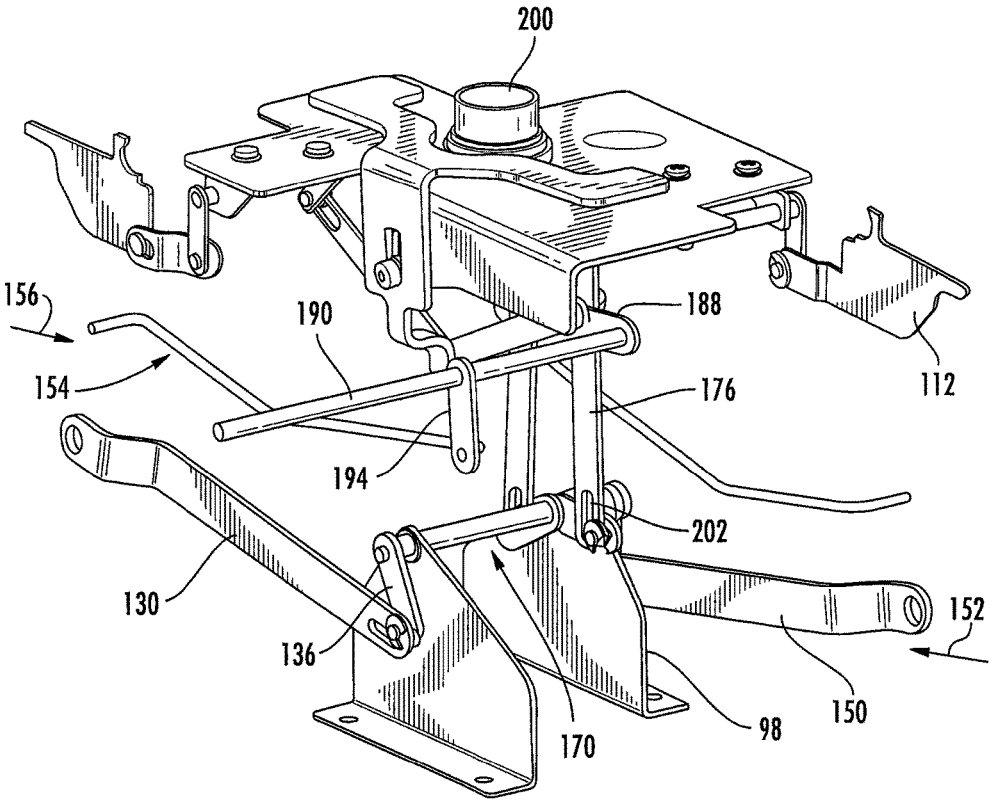

Referring to FIGS. 3-5, the central control system 80 includes first and second opposite base members 96, 98. Each of the base members 96, 98 may be coupled to the housing 84 (e.g., to the back wall 88 of the housing 84).

The central control system 80 includes a lever 100 that is coupled to a support member 102. The lever 100 is rotatably coupled to the support 102 such that the lever 100 can toggle in opposite directions. More specifically, the lever 100 include first and second opposite ends 104, 106 and the lever 100 toggles in one direction in response to an operator pressing the first end 104 and in the opposite direction in response to the operator pressing the second end 106.

The operator can manually close the desired power source (i.e., the primary source or the secondary source) by pressing one of the ends 104, 106 of the lever 100. For example, the operator may press the first end 104 of the lever 100 to manually close the primary source 40 (FIG. 1). In this way, the first contact assembly 60A is placed in a closed state or position in response to the operator pressing the first end 104 of the lever 100. Similarly, the operator may press the second end 106 of the lever 100 to manually close the secondary source 50 (FIG. 1) and to place the second contact assembly 60B in a closed state or position.

The lever 100 is operatively associated with the operating mechanisms 70A, 70B so that pressing the lever 100 initiates one of the operating mechanisms 70A, 70B to place its associated contact assembly 60A, 60B in the closed state. For example, and as illustrated, the lever 100 may be coupled to a first actuating member 110 (e.g., a first pistol actuating member) by a series of linkages and/or shafts. The first actuating member 110 may be positioned adjacent (e.g., under) the first actuator 92A. The first actuating member 110 may be coupled to the first actuator 92A and/or components associated therewith so that pressing the first end 104 of the lever 100 causes the first actuating member 110 to actuate the first actuator 92A (e.g., pull the first actuator 92A downward). In response, the first operating mechanism 70A closes the contacts 90 of the first contact assembly 60A.

Similarly, the lever 100 may be coupled to a second actuating member 112 (e.g., a second pistol actuating member) by a series of linkages and/or shafts. The second actuating member 112 may be positioned adjacent (e.g., under) the second actuator 92B. The second actuating member 112 may be coupled to the first actuator 92B and/or components associated therewith so that pressing the second end 106 of the lever 100 causes the second actuating member 112 to actuate the first actuator 92B (e.g., pull the first actuator 92B downward). In response, the second operating mechanism 70B closes the contacts 90 of the second contact assembly 60B.

Figure 8:
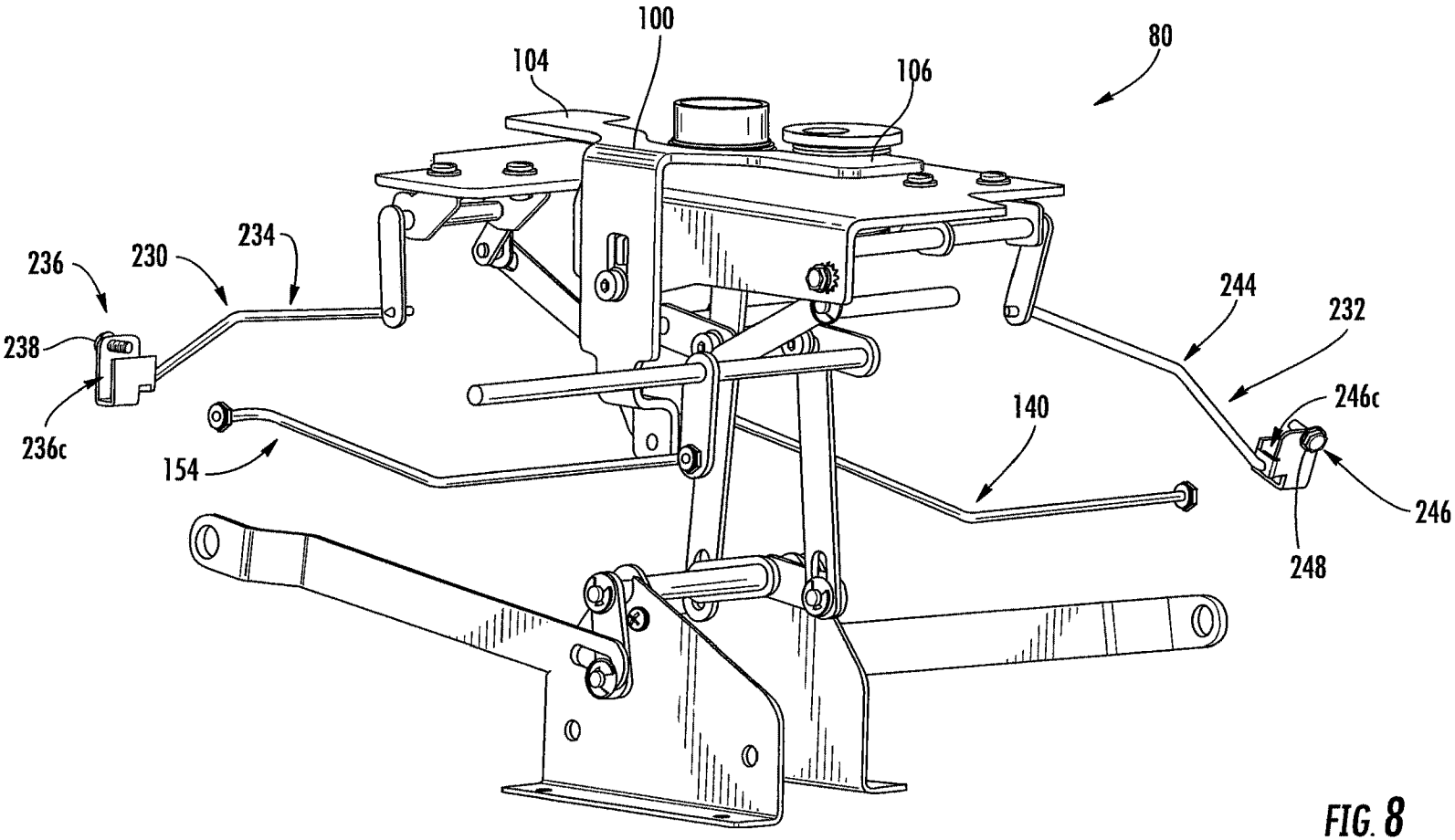
FIG. 8 is a perspective view of a central control system of the contactor assembly of FIG. 3 according to some other embodiments.
Figure 9:
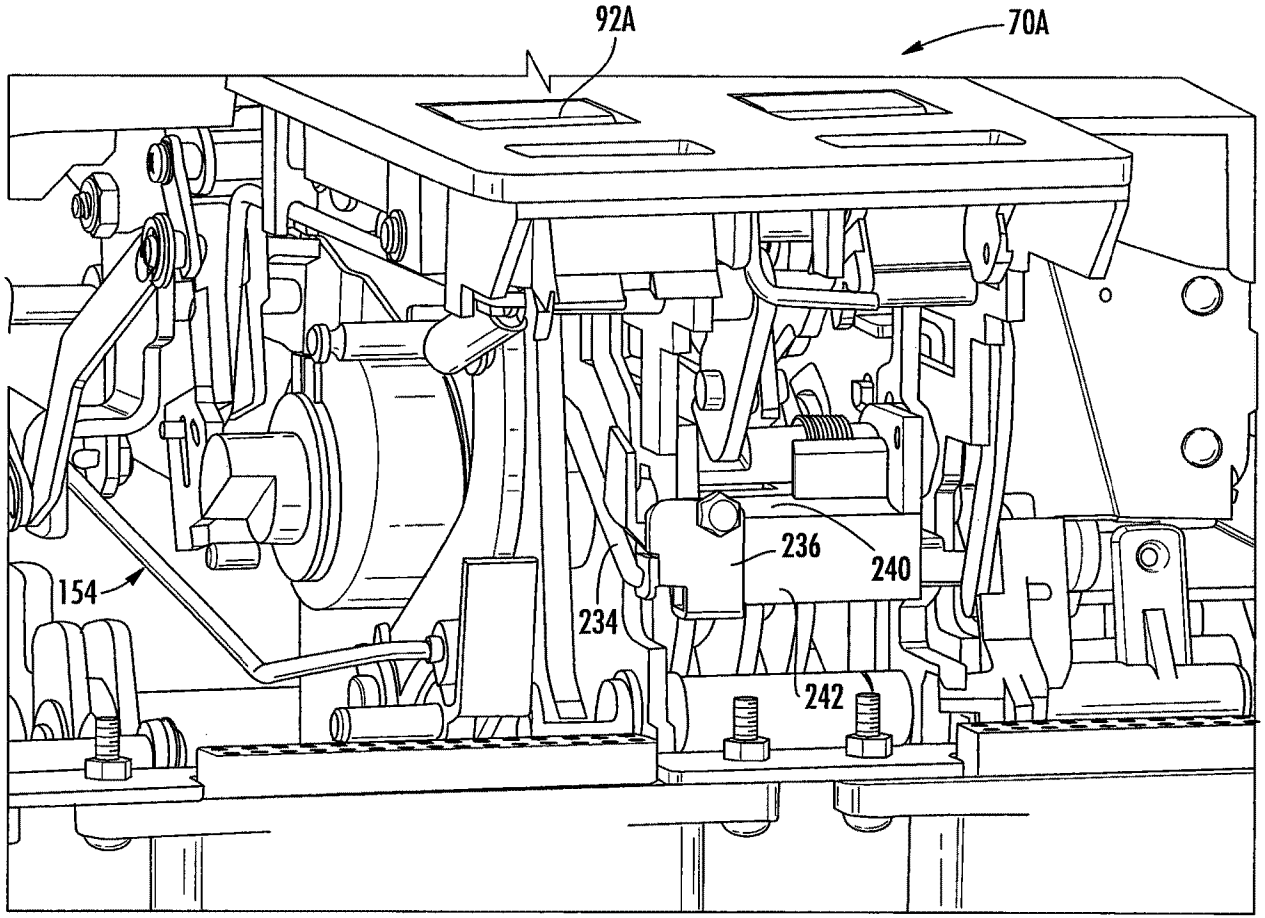
FIG. 9 is a fragmentary perspective view of an operating mechanism of the contactor assembly of FIG. 3 and the central control system of FIG. 8 according to some embodiments.

According to another embodiment, and referring to FIG. 8, the lever 100 is coupled to a first actuating member 230 by at least one shaft and/or at least one linkage. The first actuating member 230 includes a first actuating wire 234 and a first bracket 236 coupled to the wire 234. Referring to FIG. 9, the bracket 236 is coupled to a platform 240. The bracket 236 may include a channel 236*c* that is configured to receive a front plate 242 of the platform 240. The bracket 236 may additionally or alternatively be fastened to the platform 240 by fastener 238. The platform 240 is typically actuated by the first actuator 92A. With the arrangement illustrated in FIGS. 8 and 9, however, pressing the first end 104 of the lever 100 causes the first actuating member 230 to actuate the platform 140. In response, the first operating mechanism 70A closes the contacts 90 of the first contact assembly 60A.

Similarly, and still referring to FIG. 8, the lever 100 is coupled to a second actuating member 232 by at least one shaft and/or at least one linkage. The second actuating member 232 includes a second actuating wire 244 and a second bracket 246 coupled to the wire 244. The bracket 246 is coupled to a platform 140 associated with the second operating mechanism 70B that is the same or similar to the platform 140 associated with the first operating mechanism 70A described above. With this arrangement, pressing the second end 106 of the lever 100 causes the second actuating member 232 to actuate the platform 140. In response, the second operating mechanism 70B closes the contacts 90 of the second contact assembly 60B.

In response to the actuation of one of the operating mechanisms, a pole shaft associated with the operating mechanism and/or its corresponding contact assembly rotates to place the contact assembly in the closed position. For example, referring to FIG. 6, in response to an operator pressing the first end 104 of the lever 100, the first operating mechanism 70A rotates the pole shaft 120A in the direction indicated by arrow 122. One or more arms 124 on the pole shaft rotate in the same direction and close the contacts 90.

The central control system 80 is configured such that, when one of the first and second ends 104, 106 of the lever 100 is pressed to operate the corresponding operating mechanism 70A, 70B to place the corresponding contact assembly 60A, 60B in the closed state as described above, the other one of the operating mechanisms 70A, 70B is tripped so that the corresponding contact assembly 60A, 60B is locked in the open state. For example, in the operation described in the previous paragraph, the second operating mechanism 70B is tripped and the second contact assembly 60B is locked in the open state. In this state, the secondary power source will not close in response to an operator pressing the second end 106 of the lever 100. In addition, an operator pressing the first end 104 of the lever 100 will have no effect (i.e., the primary power source will remain closed). This advantageously prevents both power sources from being closed at the same time.

The central control system 80 interlocks the first and second operating mechanisms 70A, 70B to provide these advantages. An example interlock configuration will now be described with reference to FIGS. 3-6.

A first pole shaft arm 130 extends between the first base member 96 of the central control system 80 to the pole shaft 120A associated with the first contact assembly 60A and/or the first operating mechanism 70A. Specifically, a first end 132 of the first pole shaft arm 130 is coupled to the first base member 96 (or a first linkage 136 thereon) and a second end 134 of the first pole shaft arm 130 is coupled to the pole shaft 120A (or a bracket 138 thereon).

Figure 6:
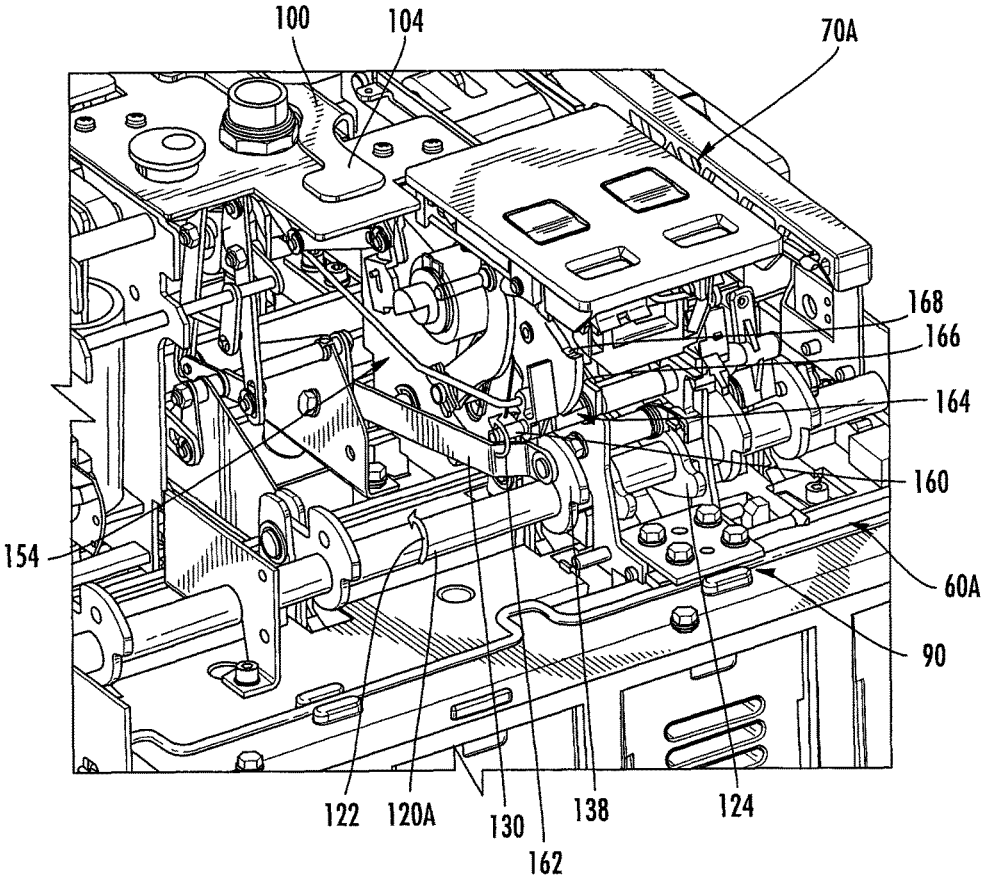
FIG. 6 is a fragmentary perspective view of a contact assembly, an operating mechanism and a central control system of the contactor assembly of FIG. 3 according to some embodiments.

The first pole shaft arm 130 is operatively coupled with a second trip shaft or wire 140 through a series of linkages and/or shafts at the central control system 80. The first pole shaft arm 130 moves in the direction indicated by the arrow 142 in response to the pole shaft 120A rotating in the direction 122 (FIG. 6). In response, the second trip wire 140 moves in the direction indicated by the arrow 144 (FIG. 4) to trip the second operating mechanism 70B and lock the second contact assembly 60B in the open state.

Referring to FIG. 3, a pole shaft 120B is associated with the second contact assembly 60B and/or the second operating mechanism 70B. Assuming the contactor assembly 82 is in its neutral or normal position (i.e., with neither the primary nor the secondary power source being closed), the pole shaft 120B rotates in the direction indicated by the arrow 146 in response to an operator pressing the second end 106 of the lever 100. This closes the contacts 90 of the second contact assembly 60B in the same or similar manner as described above in reference to the first contact assembly 60A.

Referring to FIGS. 4 and 5, and similar to the first pole shaft arm 130, a second pole shaft arm extends between the pole shaft 120B and the second base member 98. The second pole shaft arm 150 is operatively coupled with a first trip wire 154 through a series of linkages and/or shafts at the central control system 80. The second pole shaft arm 150 moves in the direction indicated by the arrow 152 in response to the rotation of the pole shaft 120B to place the second contact assembly 60B in the closed state as described in the previous paragraph. In response, the second trip wire 154 moves in the direction indicated by the arrow 156 to trip the first operating mechanism 70A and lock the first contact assembly 60A in the open state.

FIG. 6 illustrates an example configuration for tripping the first operating mechanism 70A and locking the first contact assembly 60A in the open state. An end of the first trip wire 154 is held adjacent a trip shaft 160. The trip shaft 160 rotates in the direction indicated by arrow 162 in response to the movement of the first trip wire 154 as described above. A notch 164 is defined in the trip shaft 160. A bracket 166 having a catch 168 is adjacent the trip shaft 160. As the trip shaft 160 rotates, the catch 168 is eventually received in the trip shaft notch 164. The catch 168 holds or locks the trip shaft 160 so that the first operating mechanism 70A is tripped and the first contact assembly 60A is locked in the open state.

It will be appreciated that the second contact assembly 60B and the second operating mechanism 70B may also have the same configuration. For example, the second contact assembly 60B and the second operating mechanism 70B may include the rotatable trip shaft 160 as described above.

The central control system 80 according to some embodiments will now be described in more detail with reference to FIGS. 4 and 5. A central shaft 170 extends between and is rotatably coupled to the first and second base members 96, 98. The first pole shaft arm 130 is coupled to the central shaft 170 by linkage 136. Although not visible in FIGS. 4 and 5, the second pole shaft arm 150 may also be coupled to the central shaft 170 by an identical or substantially identical linkage 136. Linkage 172 is coupled to the central shaft 170. First and second extension arms 174, 176 are coupled to opposite sides of the linkage 172.

The first extension arm 174 is coupled to linkage 178 which is coupled to (e.g., fixedly coupled to) a second trip wire shaft 180. An opposite end of the second trip wire shaft 180 is coupled to (e.g., rotatably coupled to) a mounting structure 182 which may be mounted to the housing 84 such as the back wall 88 of the housing 84 (FIG. 3). Linkage 184 is coupled to (e.g., fixedly coupled to) the second trip wire shaft 180 and the second trip wire 140 extends from the linkage 184. It will be appreciated that this configuration allows the first pole shaft arm 130 to move in the direction 142 and the second trip wire 140 to move in the direction 144 shown in FIG. 4 (and also allows the first pole shaft arm 130 to move opposite the direction 142 and the second trip wire 140 to move opposite the direction 144).

Likewise, the second extension arm 176 is coupled to linkage 188 which is coupled to (e.g., fixedly coupled to) a first trip wire shaft 190. An opposite end of the first trip wire shaft 190 is coupled to (e.g., rotatably coupled to) a mounting structure 192 which may be mounted to the housing 84 such as the back wall 88 of the housing 84 (FIG. 3). Linkage 194 is coupled to (e.g., fixedly coupled to) the first trip wire shaft 190 and the first trip wire 154 extends from the linkage 194. It will be appreciated that this configuration allows the second pole shaft arm 150 to move in the direction 152 and the first trip wire 154 to move in the direction 156 shown in FIG. 5 (and also allows the second pole shaft arm 150 to move opposite the direction 152 and the second trip wire 154 to move opposite the direction 156).

As described above, with the contactor assembly 82 in the neutral or normal position, neither the primary power source nor the secondary power source is closed. That is, neither the first contact assembly 60A nor the second contact assembly 60B is in the closed state. In the neutral position, an operator can close either the primary or secondary power source by pressing either the first lever end 104 or the second lever end 106.

Pressing the first lever end 104 will cause the first operating mechanism 70A to place the first contact assembly 60A in the closed state and close the primary power source. Because of the interlocked nature of the first and second operating mechanisms 70A, 70B, this will also rotate the trip shaft of the second operating mechanism 70B to lock the second contact assembly 60B in the open position. The second operating mechanism 70B will not operate and therefore the second contact assembly 60B will not close if the operator then presses the second lever end 106. In addition, the second operating mechanism 70B will not operate and therefore the second contact assembly 60B will not close if the operator then presses the manual actuator 92B (FIG. 3).

Alternatively, from the neutral position, pressing the second lever end 106 will cause the second operating mechanism 70B to place the second contact assembly 60B in the closed state and close the secondary power source. Because of the interlocked nature of the first and second operating mechanisms 70A, 70B, this will also rotate the trip shaft of trip the first operating mechanism 70A to lock the first contact assembly 60A in the open position. The first operating mechanism 70A will not operate and therefore the first contact assembly 60A will not close if the operator then presses the first lever end 104. In addition, the first operating mechanism 70A will not operate and therefore the first contact assembly 60A will not close if the operator then presses the manual actuator 92A (FIG. 3).

The central control system 80 also includes a central actuator 200 such as a central button. The central actuator 200 is configured to open the primary power source (e.g., move the first contact assembly 60A to the open position) if the primary power source is closed or to open the secondary power source (e.g., move the second contact assembly 60B to the open position) if the secondary power source is closed.

For example, the central actuator 200 may be operatively coupled with the first and second extension arms 174, 176. The first and second extension arms 174, 176 may be urged downwardly (e.g., toward the housing back wall 88, FIG. 3) in response to actuating the central actuator 200. Each of the first and second extension arms 174, 176 may include a slot 202 defined therein and fasteners or followers 204 associated with the linkage 172 may translate in the slots 202. The linkage 172 may be urged to rotate to a "level" position, e.g., with the linkage 172 generally parallel to the housing back wall 88. In this regard, the trip wires 140, 154 move opposite the directions 144, 156 (FIGS. 4 and 5) in response to actuating the central actuator 200 (for example, the trip wire shafts 180, 190 may rotate in response to actuating the actuator 200).

This motion of the trip wires 140, 154 causes the trip shafts 160 to rotate in a direction opposite the direction 162 shown in FIG. 6. The trip shaft notches 164 are rotated away from the catches 168 so that the operating mechanisms 70A, 70B are no longer tripped and the contact assemblies 60A, 60B are placed in the open position. In this regard, the contactor assembly 82 is returned to the neutral position in response to actuating the central actuator 200.

Referring to FIG. 3, a lock 210 may be provided on the central control system 20. The lock 210 may be used to lock the system in its neutral position so that actuation of the lever 100 in either direction will have no effect (e.g., neither the primary nor the secondary power source will be closed if the lock 210 is in a locked state).

Figure 7:
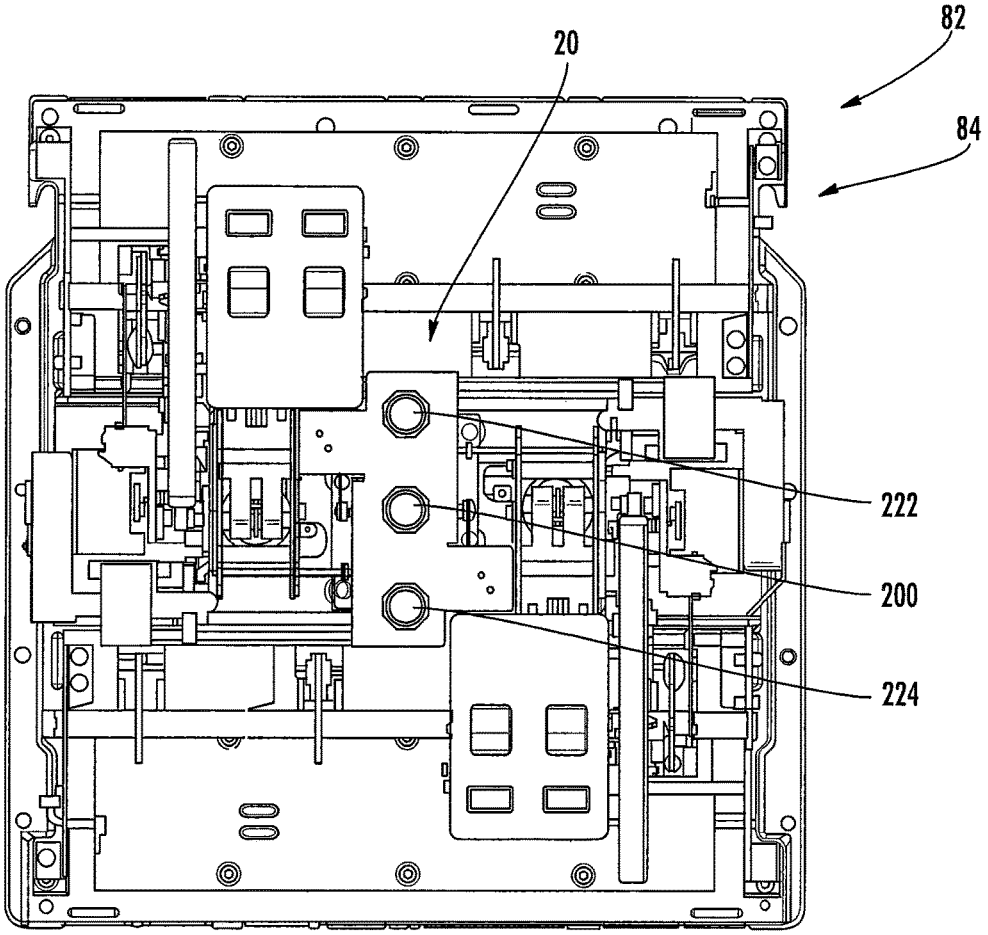
FIG. 7 is a front view of the contactor assembly of the transfer switch of FIG. 1 according to some other embodiments.

FIG. 7 illustrates an alternative embodiment of the central control system 20. Instead of the lever 100, the central control system uses first, second and third actuators 222, 224, 200 such as buttons. An operator may actuate or press the first actuator 222 instead of pressing the pressing the first end 104 of the lever 100 to perform the same operations as described above. An operator may actuate or press the second actuator 224 instead of pressing the pressing the second end 106 of the lever 100 to perform the same operations as described above. An operator may actuate or press the third or central actuator 200 to perform the same operations as described above.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A contactor assembly for a transfer switch, the contactor assembly comprising:

a housing;

first and second electromechanical operating mechanisms in the housing;

a first contact assembly in the housing and adjacent the first operating mechanism, wherein the first operating mechanism is configured to change the first contact assembly from an open state to a closed state;

a second contact assembly in the housing and adjacent the second operating mechanism, wherein the second operating mechanism is configured to change the second contact assembly from an open state to a closed state; and a mechanical central control system in the housing and coupled to each of the first and second operating mechanisms, the central control system configured to be manually actuated (i) in a first way to cause the first operating mechanism to change the first contact assembly to the closed state and to lock the second contact assembly in the open state and (ii) in a second way to cause the second operating mechanism to change the second contact assembly to the closed state and to lock the first contact assembly in the open state, wherein:

the central control system comprises a lever having first and second opposite ends;

the central control system is configured to be manually actuated in the first way by pressing the first end of the lever; and the central control system is configured to be manually actuated in the second way by pressing the second end of the lever.

2. The assembly of claim 1 wherein the first end of the lever is coupled to the first operating mechanism and the second end of the lever is coupled to the second operating mechanism.

3. The assembly of claim 1 wherein, after the central control system has been actuated in one of the first and second ways, the central control system is configured to be manually actuated in a third way so that each of the first and second contact assemblies are unlocked and in the open state.

4. The assembly of claim 3 wherein each of the first and second contact assemblies comprises one or more spring-loaded contacts that are configured to change the first or second contact assembly that was in the closed state to the open state in response to actuation of the central control system in the third way.

5. The assembly of claim 3 wherein the central control system comprises a button, and wherein the central control system is configured to be manually actuated in the third way by pressing the button.

6. The assembly of claim 3 wherein the first and second operating mechanisms are spaced apart from one another with the central control system positioned between the first and second operating mechanisms.

7. A contactor assembly for a transfer switch, the contactor assembly comprising:

a housing;

first and second electromechanical operating mechanisms in the housing;

a first contact assembly in the housing and adjacent the first operating mechanism, wherein the first operating mechanism is configured to change the first contact assembly from an open state to a closed state;

a second contact assembly in the housing and adjacent the second operating mechanism, wherein the second operating mechanism is configured to change the second contact assembly from an open state to a closed state; and a mechanical central control system in the housing and coupled to each of the first and second operating mechanisms, the central control system configured to be manually actuated (i) in a first way to cause the first operating mechanism to change the first contact assembly to the closed state and to lock the second contact assembly in the open state and (ii) in a second way to cause the second operating mechanism to change the second contact assembly to the closed state and to lock the first contact assembly in the open state;

wherein, after the central control system has been actuated in one of the first and second ways, the central control system is configured to be manually actuated in a third way so that each of the first and second contact assemblies are unlocked and in the open state;

wherein the first and second operating mechanisms are spaced apart from one another with the central control system positioned between the first and second operating mechanisms;

wherein the central control system comprises:

a first pole shaft arm coupled to a first pole shaft of the first operating mechanism, wherein the first pole shaft rotates in response to the central control system being actuated in the first way and the first pole shaft arm moves in response to the rotation of the first pole shaft;

a second pole shaft arm coupled to a second pole shaft of the second operating mechanism, wherein the second pole shaft rotates in response to the central control system being actuated in the second way and the second pole shaft arm moves in response to the rotation of the second pole shaft;

a first trip wire coupled to the first operating mechanism adjacent a first trip shaft thereof and operatively coupled to the second pole shaft arm, wherein the first trip wire rotates the first trip shaft in a first direction in response to the movement of the second pole shaft arm to lock the first operating mechanism to thereby lock the first contact assembly in the open state; and a second trip wire coupled to the second operating mechanism adjacent a second trip shaft thereof and operatively coupled to first pole shaft arm, wherein the second trip wire rotates the second trip shaft in a first direction in response to the movement of the first pole shaft arm to lock the second operating mechanism to thereby lock the second contact assembly in the open state.

8. The assembly of claim 7, wherein the first trip shaft and/or the second trip shaft rotate in a second direction that is opposite the first direction in response to actuation of the central control system in the third way.

9. A contactor assembly for a transfer switch, the contactor assembly comprising:

a housing;

first and second electromechanical operating mechanisms in the housing;

a first contact assembly in the housing and adjacent the first operating mechanism, wherein the first operating mechanism is configured to change the first contact assembly from an open state to a closed state;

a second contact assembly in the housing and adjacent the second operating mechanism, wherein the second operating mechanism is configured to change the second contact assembly from an open state to a closed state; and a mechanical central control system in the housing and coupled to each of the first and second operating mechanisms, the central control system configured to be manually actuated (i) in a first way to cause the first operating mechanism to change the first contact assembly to the closed state and to lock the second contact assembly in the open state and (ii) in a second way to cause the second operating mechanism to change the second contact assembly to the closed state and to lock the first contact assembly in the open state, wherein:

after the central control system has been actuated in one of the first and second ways, the central control system is configured to be manually actuated in a third way so that each of the first and second contact assemblies are unlocked and in the open state;

the central control system comprises first, second and third buttons;

the central control system is configured to be manually actuated in the first way by pressing the first button;

the central control system is configured to be manually actuated in the second way by pressing the second button; and the central control system is configured to be manually actuated in the third way by pressing the third button.

10. The assembly of claim 9 wherein each of the first and second contact assemblies comprises one or more spring-loaded contacts that are configured to change the first or second contact assembly that was in the closed state to the open state in response to actuation of the central control system in the third way.

11. The assembly of claim 9 wherein the first and second operating mechanisms are spaced apart from one another with the central control system positioned between the first and second operating mechanisms.

12. The assembly of claim 11 wherein the central control system comprises:

a first pole shaft arm coupled to a first pole shaft of the first operating mechanism, wherein the first pole shaft rotates in response to the central control system being actuated in the first way and the first pole shaft arm moves in response to the rotation of the first pole shaft;

a second pole shaft arm coupled to a second pole shaft of the second operating mechanism, wherein the second pole shaft rotates in response to the central control system being actuated in the second way and the second pole shaft arm moves in response to the rotation of the second pole shaft;

a first trip wire coupled to the first operating mechanism adjacent a first trip shaft thereof and operatively coupled to the second pole shaft arm, wherein the first trip wire rotates the first trip shaft in a first direction in response to the movement of the second pole shaft arm to lock the first operating mechanism to thereby lock the first contact assembly in the open state; and a second trip wire coupled to the second operating mechanism adjacent a second trip shaft thereof and operatively coupled to first pole shaft arm, wherein the second trip wire rotates the second trip shaft in a first direction in response to the movement of the first pole shaft arm to lock the second operating mechanism to thereby lock the second contact assembly in the open state.

13. The assembly of claim 12, wherein the first trip shaft and/or the second trip shaft rotate in a second direction that is opposite the first direction in response to actuation of the central control system in the third way.

14. A contactor assembly for a transfer switch, the contactor assembly comprising:

a housing;

first and second electromechanical operating mechanisms in the housing;

a first contact assembly in the housing and adjacent the first operating mechanism, wherein the first operating mechanism is configured to change the first contact assembly from an open state to a closed state, and wherein the first contact assembly is electrically connected to a primary power source and configured to close the primary power source in the closed state;

a second contact assembly in the housing and adjacent the second operating mechanism, wherein the second operating mechanism is configured to change the second contact assembly from an open state to a closed state, and wherein the second contact assembly is electrically connected to a secondary power source and configured to close the secondary power source in the closed state; and a mechanical central control system in the housing and interlocking the first and second operating mechanisms, the central control system comprising a primary power source actuator and a secondary power source actuator, the central control system configured to (i) direct the first operating mechanism to change the first contact assembly to the closed state and to lock the second contact assembly in the open state in response to actuation of the primary power source actuator and (ii) direct the second operating mechanism to change the second contact assembly to the closed state and to lock the first contact assembly in the open state in response to actuation of the secondary power source actuator, wherein the central control system comprises an open actuator, and wherein, after actuation of the primary power source actuator or the secondary power source actuator, the central control system is configured to place each of the first and second contact assemblies in an unlocked open state in response to actuation of the open actuator.

15. The assembly of claim 14 wherein each of the first and second contact assemblies comprises one or more spring-loaded contacts that are configured to change the first or second contact assembly that was in the closed state to the open state in response to actuation of the open actuator.

16. The assembly of claim 14 wherein the first and second operating mechanisms are spaced apart from one another with the central control system positioned between the first and second operating mechanisms.

17. The assembly of claim 16 wherein the central control system comprises:

a first pole shaft arm coupled to a first pole shaft of the first operating mechanism, wherein the first pole shaft rotates in response to actuation of the primary power source actuator and the first pole shaft arm moves in response to the rotation of the first pole shaft;

a second pole shaft arm coupled to a second pole shaft of the second operating mechanism, wherein the second pole shaft rotates in response to actuation of the secondary power source actuator and the second pole shaft arm moves in response to the rotation of the second pole shaft;

a first trip wire coupled to the first operating mechanism adjacent a first trip shaft thereof and operatively coupled to the second pole shaft arm, wherein the first trip wire rotates the first trip shaft in a first direction in response to the movement of the second pole shaft arm to lock the first operating mechanism to thereby lock the first contact assembly in the open state; and a second trip wire coupled to the second operating mechanism adjacent a second trip shaft thereof and operatively coupled to first pole shaft arm, wherein the second trip wire rotates the second trip shaft in a first direction in response to the movement of the first pole shaft arm to lock the second operating mechanism to thereby lock the second contact assembly in the open state.

18. The assembly of claim 17, wherein the first trip shaft and/or the second trip shaft rotate in a second direction that is opposite the first direction in response to actuation of the open actuator.

* * * * *